US009964110B2

(12) United States Patent
Kösters et al.

(10) Patent No.: US 9,964,110 B2
(45) Date of Patent: May 8, 2018

(54) BEARING ARRANGEMENT AND WEAR INDICATOR FOR A LIQUID RING VACUUM PUMP

(71) Applicant: STERLING INDUSTRY CONSULT GMBH, Itzehoe (DE)

(72) Inventors: Heiner Kösters, Itzehoe (DE); Matthias Tamm, Itzehoe (DE); Daniel Schütze, Itzehoe (DE)

(73) Assignee: Sterling Industry Consult GmbH, Itzehoe (DE)

( * ) Notice: Subject to any disclaimer, the term of this patent is extended or adjusted under 35 U.S.C. 154(b) by 423 days.

(21) Appl. No.: 14/359,625

(22) PCT Filed: Nov. 22, 2012

(86) PCT No.: PCT/EP2012/073294
§ 371 (c)(1),
(2) Date: May 21, 2014

(87) PCT Pub. No.: WO2013/076176
PCT Pub. Date: May 30, 2013

(65) Prior Publication Data

US 2014/0322039 A1 Oct. 30, 2014

(30) Foreign Application Priority Data

Nov. 24, 2011 (EP) ..... 11190556

(51) Int. Cl.
*F04C 19/00* (2006.01)
*F04C 28/28* (2006.01)
(Continued)

(52) U.S. Cl.
CPC ..... *F04C 19/004* (2013.01); *F04C 19/00* (2013.01); *F04C 19/007* (2013.01); *F04C 28/28* (2013.01);
(Continued)

(58) Field of Classification Search
CPC ..... F04C 18/00; F04C 19/004; F04C 19/007; F04C 7/00; F04C 28/06; F04C 28/28;
(Continued)

(56) References Cited

U.S. PATENT DOCUMENTS 2,145,644 A * 1/1939 Brace ..... F04C 19/007 417/68
3,584,974 A * 6/1971 Nicastro ..... F04D 9/048 417/202
(Continued)

FOREIGN PATENT DOCUMENTS

CN 201636007 11/2010
DE 01293942 4/1969
(Continued)

OTHER PUBLICATIONS

Search Report PCT/EP2012/073294.
(Continued)

*Primary Examiner* — Bryan Lettman
*Assistant Examiner* — Timothy Solak
(74) *Attorney, Agent, or Firm* — Alix, Yale & Ristas, LLP

(57) ABSTRACT

A liquid-ring vacuum pump comprises a pump casing and a shaft eccentrically mounted in the pump casing. An impeller and a rotor of a drive motor are connected to the shaft. A disk cam is arranged parallel to the impeller. A first main bearing for the shaft is arranged between the impeller and the rotor of the drive motor, on the plane of the disk cam. The impeller is arranged between the first main bearing and a second main bearing. The arrangement of the bearings prevents the shaft from bending, thus allowing the leakage gap between the impeller and the disk cam to be kept small.

20 Claims, 1 Drawing Sheet

(51) Int. Cl.
*F04C 29/00* (2006.01)
*F04C 7/00* (2006.01)

(52) U.S. Cl.
CPC ..... *F04C 29/0057* (2013.01); *F04C 7/00* (2013.01); *F04C 2220/10* (2013.01); *F04C 2240/56* (2013.01); *F04C 2240/801* (2013.01); *F04C 2270/165* (2013.01)

(58) Field of Classification Search
CPC ..... F04C 29/0057; F04C 2220/10; F04C 2240/50; F04C 2240/54; F04C 2240/56; F04C 2240/801; F04C 2240/81; F04C 2270/16; F04C 2270/165; F04C 19/005; F04C 27/02; F04C 19/00; H02K 7/08; H02K 7/09
See application file for complete search history.

(56) References Cited

U.S. PATENT DOCUMENTS 5,295,794 A * 3/1994 Haavik ..... F04C 19/002 415/173.1
5,779,445 A * 7/1998 Yokota ..... F04D 29/126 415/174.2
5,939,813 A * 8/1999 Schob ..... F04D 13/0673 310/156.25
2003/0202895 A1* 10/2003 Althouse ..... F01C 21/0809 418/2
2009/0290993 A1* 11/2009 Assaf ..... F01C 17/02 417/68

FOREIGN PATENT DOCUMENTS

| | | |
|---|---|---|
| DE | 03809929 | 10/1989 |
| EP | 0519192 | 2/1995 |
| GB | 01355193 | 6/1974 |
| JP | H10184564 | 7/1998 |
| WO | WO9708808 | 3/1997 |

OTHER PUBLICATIONS

Search Report CN 2012800057939.
European Office Action 12 791 468.7.
Mexican Office Action dated Apr. 21, 2017.

* cited by examiner

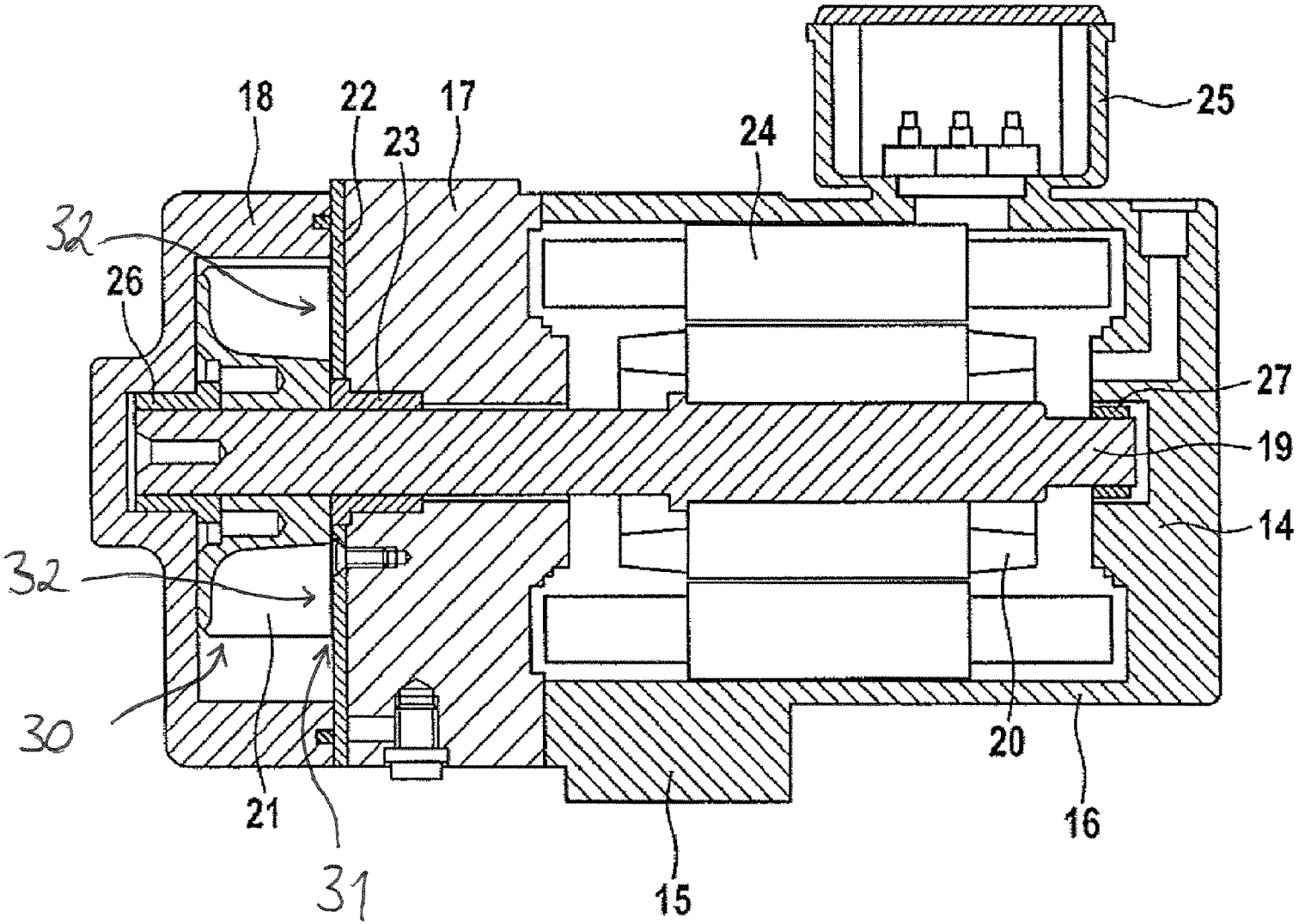
25
27
19
14
16
20
24
15
17
23
22
31
18
21
26
32
32
30

BEARING ARRANGEMENT AND WEAR INDICATOR FOR A LIQUID RING VACUUM PUMP

BACKGROUND

The invention relates to a liquid-ring vacuum pump having a shaft which is mounted eccentrically in a pump housing. An impeller and a rotor of a drive motor are connected to the shaft. A control disk is arranged parallel to the impeller.

Pumps of this type can be used for evacuating containers or other closed spaces. An inlet opening of the pump is connected to the space to be evacuated, the gas which is contained in the space is sucked into the inlet opening, is compressed in the pump and is output again through an outlet opening.

In liquid-ring vacuum pumps, a liquid ring is kept in motion by way of the impeller, with the result that the chambers between the vanes of the impeller are closed by the liquid ring. Since the impeller is mounted eccentrically in the pump housing, the liquid ring penetrates to different extents into the chamber depending on the angular position of the impeller and, as a result, acts as a piston which changes the volume of the chamber. The entire force which is required for this purpose is transmitted by the shaft and the impeller.

Liquid-ring vacuum pumps of monobloc design classically consist of a standard electric motor and the pump which is flange-connected thereto fixedly. The pump and motor are separated hydraulically with the aid of a slide ring seal. The pump does not have any dedicated bearings, with the result that the bearings of the electric motor are used to absorb the process forces. Said bearings are normally reinforced. The process forces act in the radial and the axial direction on the cantilevered impeller and subject the shaft to a compressive load and, above all, to a bending load. This deflection has to be taken into consideration during the design of the pump by sufficient tolerances being provided. In particular, a distance has to be maintained between the impeller and the control disk because deflection of the shaft otherwise leads to the impeller otherwise butting against the control disk. However, tolerances between the impeller and the control disk are associated with leakage losses which reduce the degree of efficiency of the pump.

SUMMARY

A liquid-ring vacuum pump, in which the leakage losses are reduced is proposed. A first and a second main bearing are provided for the shaft. The first main bearing is arranged between the impeller and the rotor in the plane of the control disk. The impeller is arranged between the first main bearing and the second main bearing.

First of all, some terms will be explained. The impeller and the rotor of the drive motor lie on a common shaft. This is a pump of monobloc design, in which there is no shaft flange between the rotor and the impeller. The term main bearing denotes a rotary bearing, in which the shaft is guided statically. Even if the shaft is not rotating, it is held in a defined position by the main bearings. A hydrodynamic bearing which can absorb bearing forces only when the shaft is rotating is not a main bearing in this sense. Sliding bearings or anti-friction bearings may be suitable as main bearings, for example. The main bearings are preferably lubricated by the operating liquid of the pump.

The pump housing denotes the part of the pump in which the impeller is accommodated. The eccentric mounting of the shaft therefore relates to the impeller in the pump housing. In other sections of the pump, the shaft can be arranged centrally. The openings, through which the gas to be delivered enters into the chambers of the impeller and exits again are formed in the control disk which is arranged adjacently with respect to the impeller. It is not ruled out that the control disk is machined directly into the housing. As a rule, however, the control disk is a separate component which is connected to the housing.

It is disadvantageous if the shaft is deflected in the central region between the drive motor and the impeller. A greater tolerance then has to be maintained between the impeller and the control disk, which results directly in the increased leakage losses. It is therefore proposed to arrange the first main bearing and the second main bearing adjacently with respect to the impeller. The shaft is then mounted in the region in which a large part of the forces which act on the shaft are produced, and it becomes possible to arrange the impeller at a small distance from the control disk, with the result that the leakage losses are reduced.

It is appropriate to absorb the process forces as close as possible to the impeller. The first main bearing is therefore arranged in the plane of the control disk. In classic bearing designs (cf., for instance, GB 1 355 193, DE 1 293 942), at most seals are provided in the plane of the control disk.

The extent of the main bearing in the axial direction is as a rule greater than the thickness of the control disk, with the result that the main bearing protrudes beyond the control disk in one or in both directions. The first main bearing is preferably designed in such a way that, apart from radial forces, it can also absorb axial forces from the shaft. The absorbing of the axial forces can take place via that end face of the first main bearing which points in the direction of the impeller. For this purpose, the main bearing can be arranged in such a way that it protrudes beyond the control disk in the axial direction. The second main bearing can be designed in such a way that it absorbs only radial forces and not axial forces from the shaft.

The control disk itself is generally a component which is not suitable for absorbing great loads. In order to keep the control disk free of loads by way of the main bearing, the main bearing can be held in a housing part which is arranged adjacently with respect to the control disk. The control disk is situated between said housing part and the impeller. The rotor of the drive motor is preferably arranged on the other side of the housing part. The shaft therefore extends through the housing, with the result that the rotor is arranged on one side and the impeller is arranged on the other side of the housing part.

It is not ruled out that the pump can have more than two main bearings. If further bearings are provided, they are as a rule auxiliary bearings which have smaller dimensions than the main bearings. In this case, the main bearings are the two largest bearings of the shaft.

In one advantageous embodiment, precisely two main bearings are provided. Although the rotor of the drive motor then represents a comparatively large mass on the shaft, which mass is not arranged between the two main bearings, the rotor is normally free of unbalances, with the result that no great forces act on the shaft there. Moreover, the motor itself can absorb bearing forces to a certain extent. A hydrodynamic bearing is namely formed as a result of the operating liquid, in which the rotor rotates, if the gap between the rotor and the stator of the drive motor is sufficiently small.

If the shaft is no longer mounted on the other side (as viewed from the impeller) of the rotor, damage can occur to the rotor and the stator of the drive motor when the main bearings become worn. In order to reduce the risk of damage of this type, a run-on ring can be provided on the other side of the rotor. No bearing forces occur in the run-on ring during normal operation. The run-on ring can be designed in such a way that the shaft has play in the run-on ring. The function of the run-on ring is exhibited only when one of the main bearings is worn. In this case, the run-on ring prevents the rotor and the stator of the drive motor coming into contact with one another. Moreover, the run-on ring can be used as a wear indicator, by a conclusion being made about wear of one of the remaining bearings if the bearing forces in the run-on ring exceed a predefined threshold.

In order to keep the leakage losses low, the distance between the impeller and the control disk has to be small. To this end, it is necessary to set the axial position of the shaft precisely. In one advantageous embodiment, the axial position of the shaft is defined by virtue of the fact that the impeller bears against an end face of the first main bearing. For this purpose, the first main bearing protrudes slightly beyond the plane of the control disk. Although the axial position of the first main bearing then has to be set exactly during assembly of the pump, no setting work is required beyond this.

The impeller is preferably designed in such a way that a force is generated in the direction of the first main bearing as a result of the rotation which takes place during operation of the pump. If the shaft has a slight play in the axial direction, the impeller is pressed automatically by said force against the end face of the main bearing.

At the end which lies opposite the control disk, the chambers of the impeller are preferably closed by way of a flanged disk which protrudes as far as into the liquid ring during operation of the pump. The leakage gap between the impeller and the control disk is then the only leakage gap of the pump. On the other side of the flanged disk, the working space of the pump can be closed by way of a housing cover.

BRIEF DESCRIPTION OF THE DRAWINGS

In the following text, the invention will be described by way of example using one advantageous embodiment with reference to the appended drawing, in which:

FIG. 1 shows a diagrammatic cross-sectional view of a pump.

DETAILED DESCRIPTION

A liquid-ring vacuum pump in FIG. 1 comprises a housing 14 with a base 15. A shaft 19 is mounted in the housing 14, which shaft 19 extends transversely through the housing 14 from the left-hand end as far as the right-hand end. The shaft 19 supports a rotor 20 of a drive motor of the pump on one side and an impeller 21 on the other side, by way of which impeller 21 the gas to be delivered is transported.

The housing 14 is composed in the axial direction of three housing parts 16, 17, 18, the impeller 21 being accommodated in the housing part 18 which is shown on the left in FIG. 1 and the drive motor being accommodated in the housing part 16 which is shown on the right. The drive motor comprises the rotor 20 which is connected to the shaft 19 and a stator 24 which is connected to the housing part 16. Electrical energy is fed to the drive motor via a power supply 25, with the result that the shaft 19 is set in rotation together with the impeller 21. The medium to be transported is delivered by way of the rotation of the impeller 21, as will be explained in greater detail below.

The shaft 19 is mounted by way of a first main bearing 23 and a second main bearing 26 which are arranged on both sides of the impeller 21 at a slight distance from the impeller 21. The first main bearing 23 is held in the central housing part 17 and extends from there just beyond the plane of the control disk 22. The second main bearing 26 is situated in the end side of the housing part 18 and extends from the end of the shaft 19 as far as the impeller 21. The two main bearings 23, 26 are arranged in the region in which the strongest forces are transmitted to the shaft 19 by the impeller 21.

Only low forces still act on the shaft 19 between the first main bearing 23 and the other end of the shaft 19. The drive motor 19 forms its own hydrodynamic bearing as a result of the thin gap between the rotor 20 and the stator 24, which gap is filled with operating liquid during operation of the pump. The shaft 19 has play in the run-on ring 27 which is provided at the other end of the shaft. The run-on ring 27 therefore does not absorb any bearing forces during normal operation, but rather serves for additional safety if the main bearings 23, 26 become worn. It can be determined by way of a suitable sensor on the run-on ring 27 if bearing forces are occurring in the run-on ring 27. The occurrence of bearing forces can be understood as an indication of the start of wear of the pump.

The impeller 21 is mounted eccentrically in the housing part 18 which forms the actual pump housing. When the impeller rotates, an operating liquid is set in motion, with the result that a liquid ring which moves with the impeller is produced in the pump housing. Depending on the angular position of the impeller, the liquid ring penetrates to a greater or lesser depth into the chambers 30 of the impeller. As a result, the liquid ring acts as a piston which moves up and down in the chambers 30. The gas to be delivered is sucked in the region in which the volume of the chamber 30 is increased, and is output again in the region in which the volume of the chamber 30 is decreased.

Ducts which are not shown in FIG. 1 are provided in the central housing part 17 for the supply and discharge of the gas. The ducts open in a control disk 22 which is provided with openings 32. The openings 32 are arranged in such a way that the gas can enter into the chamber 30 and exit the chamber 30 in the correct region.

There necessarily has to be a gap between the control disk 22 and the impeller 21, in order that the impeller 21 can rotate freely. At the same time, said gap forms a leakage gap 31 of the pump, through which leakage gap 31 the gas to be delivered can escape from one chamber 30 into the next chamber 30. On the opposite side of the impeller 21, the chambers 30 are closed by way of a wall which protrudes as far as into the liquid ring during operation of the pump.

In order to keep the leakage gap 31 small between the impeller 21 and the control disk 22, the impeller 21 has to be positioned exactly in the longitudinal direction. In the pump, the position of the impeller 21 is defined by virtue of the fact that the impeller bears against an end face of the first main bearing 23. The first main bearing 23 is held in the central housing part 17, with the result that the bearing forces are transferred to there and not to the control disk 22. Starting from the central housing part 17, the first main bearing 23 protrudes somewhat beyond the control disk 22 in the direction of the impeller 21. If the impeller 21 bears against the end face of the first main bearing 23, the impeller therefore maintains a defined distance from the control disk 22. The impeller 21 is designed in such a way that a force which acts in the direction of the control disk 22 is produced during operation of the pump. As a result, the impeller 21 assumes the desired position in the pump automatically.

The invention claimed is:

1. A liquid-ring vacuum pump having a pump housing, having a shaft which is mounted eccentrically in the pump housing, an impeller and a rotor of a drive motor being connected to the shaft, and having a control disk defining a plane which is arranged parallel to the impeller, a first main bearing and a second main bearing being provided for the shaft, the first main bearing being arranged between the impeller and the rotor, and the impeller being arranged between the first main bearing and the second main bearing, characterized in that the first main bearing is arranged in the plane of the control disk, and the pump further comprises an operating liquid, wherein during operation of the pump, the impeller, impeller vanes, the control disk, and the operating liquid form chambers, and the control disk opens and closes the chambers, wherein a leakage gap is formed between the impeller and the control disk, and the control disk comprises openings through which a medium to be pumped can enter and exit the chambers.

2. The liquid-ring vacuum pump as claimed in claim 1, characterized in that the first main bearing is held in a housing part which is arranged adjacently with respect to the control disk.

3. The liquid-ring vacuum pump as claimed in claim 2, characterized in that the first main bearing is designed to absorb radial forces and axial forces from the shaft.

4. The liquid-ring vacuum pump as claimed in claim 2, characterized in that the second main bearing is designed to absorb radial forces from the shaft.

5. The liquid-ring vacuum pump as claimed in claim 2 wherein the drive motor has a stator, characterized in that the rotor and the stator of the drive motor form a hydrodynamic bearing for the shaft.

6. The liquid-ring vacuum pump as claimed in claim 2, characterized in that a run-on ring is provided on a side of the rotor of the drive motor opposite to the impeller.

7. The liquid-ring vacuum pump as claimed in claim 2, characterized in that the shaft has an axial position defined by the impeller bearing against an end face of the first main bearing.

8. The liquid-ring vacuum pump as claimed in claim 1, characterized in that the first main bearing is designed to absorb radial forces and axial forces from the shaft.

9. The liquid-ring vacuum pump as claimed in claim 8, characterized in that the second main bearing is designed to absorb radial forces from the shaft.

10. The liquid-ring vacuum pump as claimed in claim 8 wherein the drive motor has a stator, characterized in that the rotor and the stator of the drive motor form a hydrodynamic bearing for the shaft.

11. The liquid-ring vacuum pump as claimed in claim 8, characterized in that a run-on ring is provided on a side of the rotor of the drive motor opposite to the impeller.

12. The liquid-ring vacuum pump as claimed in claim 1, characterized in that the second main bearing is designed to absorb radial forces from the shaft.

13. The liquid-ring vacuum pump as claimed in claim 12, characterized in that the rotor and the stator of the drive motor form a hydrodynamic bearing for the shaft.

14. The liquid-ring vacuum pump as claimed in claim 12, characterized in that a run-on ring is provided on a side of the rotor of the drive motor opposite to the impeller.

15. The liquid-ring vacuum pump as claimed in claim 1 wherein the drive motor has a stator, characterized in that the rotor and the stator of the drive motor form a hydrodynamic bearing for the shaft.

16. The liquid-ring vacuum pump as claimed in claim 15, characterized in that a run-on ring is provided on a side of the rotor of the drive motor opposite to the impeller.

17. The liquid-ring vacuum pump as claimed in claim 1, characterized in that a run-on ring is provided on a side of the rotor of the drive motor opposite to the impeller.

18. The liquid-ring vacuum pump as claimed in claim 17, characterized in that the run-on ring concurrently serves as a wear indicator.

19. The liquid-ring vacuum pump as claimed in claim 1, characterized in that the shaft has an axial position defined by the impeller bearing against an end face of the first main bearing.

20. The liquid-ring vacuum pump as claimed in claim 1, characterized in that during operation, the impeller has a rotation and generates force in a direction of the first main bearing as a result of the rotation during operation of the pump.

* * * * *